US007103935B2

(12) United States Patent
Hill

(10) Patent No.: US 7,103,935 B2
(45) Date of Patent: Sep. 12, 2006

(54) MARINE GANGWAY TO ENABLE HANDICAPPED USERS TO MOVE BETWEEN FLOATING AND FIXED LANDINGS AND RELATED METHODS

(76) Inventor: David Hill, 3510 Seaman Ave., St. Cloud, FL (US) 34772

( * ) Notice: Subject to any disclaimer, the term of this patent is extended or adjusted under 35 U.S.C. 154(b) by 100 days.

(21) Appl. No.: 11/024,091

(22) Filed: Dec. 28, 2004

(65) Prior Publication Data

US 2005/0150064 A1 Jul. 14, 2005

Related U.S. Application Data

(60) Provisional application No. 60/535,054, filed on Jan. 8, 2004.

(51) Int. Cl.
*E01D 15/00* (2006.01)
*E01D 19/10* (2006.01)

(52) U.S. Cl. ..... 14/71.3; 14/69.5; 14/71.1; 14/71.5; 114/362; 187/200; 187/245; 414/921

(58) Field of Classification Search ..... 14/71.3, 14/69.5, 71.1, 71.5; 114/362; 187/200, 187/245; 414/921
See application file for complete search history.

(56) References Cited

U.S. PATENT DOCUMENTS

| | | | | |
|---|---|---|---|---|
| 2,212,388 A | | 8/1940 | Cheney | 187/12 |
| 3,966,022 A | | 6/1976 | Cheney | 187/12 |
| 4,046,226 A | | 9/1977 | Flinchbaugh | 187/12 |
| 4,174,023 A | * | 11/1979 | Dooley | 187/201 |
| 4,179,012 A | * | 12/1979 | Heberle | 187/201 |
| 5,230,405 A | | 7/1993 | Bartelt | 187/12 |
| 5,476,155 A | | 12/1995 | Nakatani et al. | 187/202 |
| 5,476,156 A | | 12/1995 | Gerber | 187/245 |
| 5,489,181 A | | 2/1996 | Greaves | 414/398 |
| 5,533,594 A | | 7/1996 | Tremblay | 187/201 |
| 5,720,364 A | | 2/1998 | Glover | 187/201 |
| 5,967,265 A | | 10/1999 | Bruno et al. | 187/201 |
| 6,105,726 A | * | 8/2000 | Taylor et al. | 187/201 |
| 6,109,854 A | | 8/2000 | Thompson, Jr. et al. | 414/398 |
| 6,175,982 B1 | * | 1/2001 | Cushwa | 14/69.5 |
| 6,332,512 B1 | | 12/2001 | Muranaka | 187/201 |

(Continued)

FOREIGN PATENT DOCUMENTS

DE 2545249 A1 * 10/1975

(Continued)

OTHER PUBLICATIONS

Burdens Extended Stairs, product description, 1999 Invention Technologies, Inc., available at www.invent-tech.com (Continued)

*Primary Examiner*—Raymond Addie
(74) *Attorney, Agent, or Firm*—Allen, Dyer, Doppelt, Milbrath & Gilchrist, P.A.

(57) ABSTRACT

A marine gangway to enable handicapped users to move between floating and fixed landings may include a gangway ramp extending between the floating and fixed landings, and at least one rail carried by the gangway ramp. The marine gangway may further include a drive unit coupled to the at least one rail and movable between the floating and fixed landings, and a handicapped user lift unit carried by the drive unit and pivoting with respect thereto to be level at at least one of the floating and fixed landings. As such, the lift unit may remain level in a loading/unloading position at the floating or fixed landing despite changes in inclination of the gangway ramp, which prevents damage to the lift unit as a result thereof.

27 Claims, 5 Drawing Sheets

U.S. PATENT DOCUMENTS

| | | | | |
|---|---|---|---|---|
| 6,435,308 | B1 | 8/2002 | Grass | 187/201 |
| 6,739,430 | B1 * | 5/2004 | Hill | 187/245 |
| 2002/0011383 | A1 | 1/2002 | Grass | 187/201 |

FOREIGN PATENT DOCUMENTS

| | | | |
|---|---|---|---|
| DE | 3425998 | A1 * | 7/1984 |
| EP | 0560433 | | 9/1993 |
| GB | 2184707 | | 7/1987 |
| JP | 5-116868 | | 5/1993 |

OTHER PUBLICATIONS

Garaventa Stair-Lift, product brochure, Garaventa (Canada) Ltd., 1995.

* cited by examiner

MARINE GANGWAY TO ENABLE HANDICAPPED USERS TO MOVE BETWEEN FLOATING AND FIXED LANDINGS AND RELATED METHODS

CROSS-REFERENCE TO RELATED APPLICATIONS

This application claims the benefit of U.S. Provisional Application No. 60/535,054, filed Jan. 8, 2004, which is hereby incorporated herein in its entirety by reference.

FIELD OF THE INVENTION

The present invention relates to the field of lifts for handicapped users, and, more particularly, to a marine gangway and accompanying lift for handicapped users and related methods.

BACKGROUND OF THE INVENTION

Various types of motorized lifts are commonly used for transporting persons with disabilities up and down an incline or between different levels in a building. One common type of lift is the stair lift, which typically travels along a rail mounted adjacent a staircase. Such lifts may provide a relatively inexpensive and more practical alternative to passenger elevators in certain applications, such as where only a small incline has to be traversed (e.g., a single flight of stairs or a few steps), or in buildings which do not have room for a large passenger elevator.

Stair lifts typically take one of two forms, i.e., a wheelchair lift with a platform for carrying a wheelchair, or a chair lift in which the user sits on a chair that moves up and down the stairs. One example of a wheelchair stair lift is provided in U.S. Pat. No. 4,046,226 to Flinchbaugh, which discloses an elevator platform for wheelchairs that rides on parallel tracks mounted on either side of the staircase. Another wheelchair lift is disclosed in U.S. Pat. No. 3,966,022 to Cheney that travels along a rail or guide channel positioned on one side of the staircase.

An exemplary chair lift device for stairways is disclosed in U.S. Pat. No. 5,230,405 to Bartlet. This chair lift includes a rail incorporating a gear rack, a carriage unit having a motor and gear box which operatively engages the gear rack to provide motion of the chair lift, and a collapsible seat assembly mounted to the carriage unit. The carriage unit also incorporates a battery unit and control circuitry to control operation of the chair lift. The seat assembly is pivotable on a swivel mechanism which permits the seat assembly to be locked in different positions.

One difficulty that is sometimes encountered in the installation of stair lift systems is when the inclination of the stair railing changes, such as for stairways which have an intermediate landing. This can be problematic in that if the lift is attached to the railing at a fixed angle, the lift will tilt when it transitions between levels, potentially causing the user to fall off.

As a result, various stair lift systems have been developed for use in such applications that keep the lift level during travel. By way of example, European Patent Publication No. 560,433 to Van't Schip et al. discloses a gear-driven stairway chair lift which also includes a chair-leveling device. The leveling mechanism levels the chair based upon the position of the lift along the stairway. Another similar stairway chair lift is disclosed in U.S. Pat. No. 5,720,364 to Glover. The lift levels its chair based upon the angular position of the lift along a guide rail. The angular position is determined by counting rotations of the drive motor or drive gear.

U.S. Pat. No. 5,967,265 to Bruno et al. discloses a gear-driven chair lift which runs on a rail having a retaining surface and guide surfaces. The guide surfaces have a slope or degree of inclination which varies based upon the slope or degree of inclination of the rail, and the guide surfaces maintain the chair at a constant incline angle (i.e., level) despite the angle or curvature of the rail.

Japanese Patent No. 5,116,868 to Yoshiaki et al. discloses an elevator for a staircase that includes a driving body for guiding the elevator along a rail mounted along side the staircase. The drive mechanism is a gear that mates with a toothed track on the rail. The elevator body carries a chair, and a detecting sensor is used to detect an incline angle of the driving body relative to the rail. An angle adjusting means is used to adjust a relative incline angle between the driving body and the chair based upon the detected incline angle. Thus, the elevator maintains a constant incline position for the chair (i.e., horizontally level) while traveling up and down the staircase, even where the rail changes angles and is horizontal.

Despite the advancements in stairway lifts, these systems may not be suitable for use in transporting handicapped persons in other applications. By way of example, another situation in which handicapped users need to traverse an incline is in boarding ships. That is, even though many marine gangways have a flat ramp instead of stairs, it may still be difficult for a handicapped person to walk or move a wheelchair up or down a gangway at a fairly steep incline by themselves.

Yet, because marine gangways are often attached to ships or floating docks which go up and down with tidal changes, the incline of the gangway changes as well. Thus, stairway lifts that rely on the angle of the lift to the railing, or the angular position of the lift along the railing, would not be able to maintain a lift in a level position in traveling or loading/unloading positions.

SUMMARY OF THE INVENTION

In view of the foregoing background, it is therefore an object of the present invention to provide a marine gangway that enables handicapped users to more readily move between floating and fixed landings and related methods.

This and other objects, features, and advantages in accordance with the present invention are provided by a marine gangway to enable handicapped users to move between floating and fixed landings which may include a gangway ramp extending between the floating and fixed landings, and at least one rail carried by the gangway ramp. The marine gangway may further include a drive unit coupled to the at least one rail and movable between the floating and fixed landings, and a handicapped user lift unit carried by the drive unit and pivoting with respect thereto to be level at at least one of the floating and fixed landings. As such, the handicapped user lift unit may remain level in a loading/unloading position at the floating or fixed landing despite changes in inclination of the gangway ramp, which prevents damage to the lift unit as a result thereof. Moreover, the handicapped user lift unit may also pivot to be level while moving between the fixed and floating landings, to thereby keep the user level while traveling along the gangway ramp.

The marine gangway may further include at least one controller for controlling the drive unit and the handicapped user lift unit. The marine gangway may also include an inclinometer for determining an inclination of the handicapped user lift unit, and the handicapped user lift unit may pivot based upon the determined inclination of the handicapped user lift.

More particularly, the handicapped user lift unit may include a handicapped user platform. The lift unit may also include a pivot actuator for pivoting the handicapped user platform, as well as a lift actuator carried by the drive unit for raising and lowering the handicapped user platform between a traveling position and a loading position at at least one of the floating and fixed landings. In addition, the handicapped user platform may have upper and lower surfaces, and a pressure-sensitive switch may be carried on the lower surface of the handicapped user platform. The pressure-sensitive switch is for causing the lift actuator to disengage, i.e., to stop lowering the platform, upon activation of the switch. The handicapped user lift unit may further include at least one loading ramp carried by the handicapped user platform. In addition, the handicapped user lift unit may include a seat for the handicapped user.

The marine gangway may further include a user control device, and the drive unit may move based upon the user control device. Also, the marine gangway may include a toothed rack carried by the at least one rail, and the drive unit may include a pinion for engaging the toothed rack. Furthermore, a plurality of posts may be connected to the gangway and extend vertically upward therefrom, and the at least one rail may be carried by the plurality of posts. Additionally, at least one guide roller may be carried by the drive unit for guiding the drive unit along the at least one rail.

A method aspect of the invention is for using a handicapped user lift including a drive unit and a handicapped user lift unit carried thereby. The method may include positioning a gangway ramp having at least one rail carried thereby between floating and fixed landings, coupling the drive unit to the at least one rail, moving the drive unit between the floating and fixed landings, and pivoting the handicapped user lift unit with respect to the drive unit to be level at at least one of the floating and fixed landings.

DETAILED DESCRIPTION OF THE PREFERRED EMBODIMENTS

Figure 1:
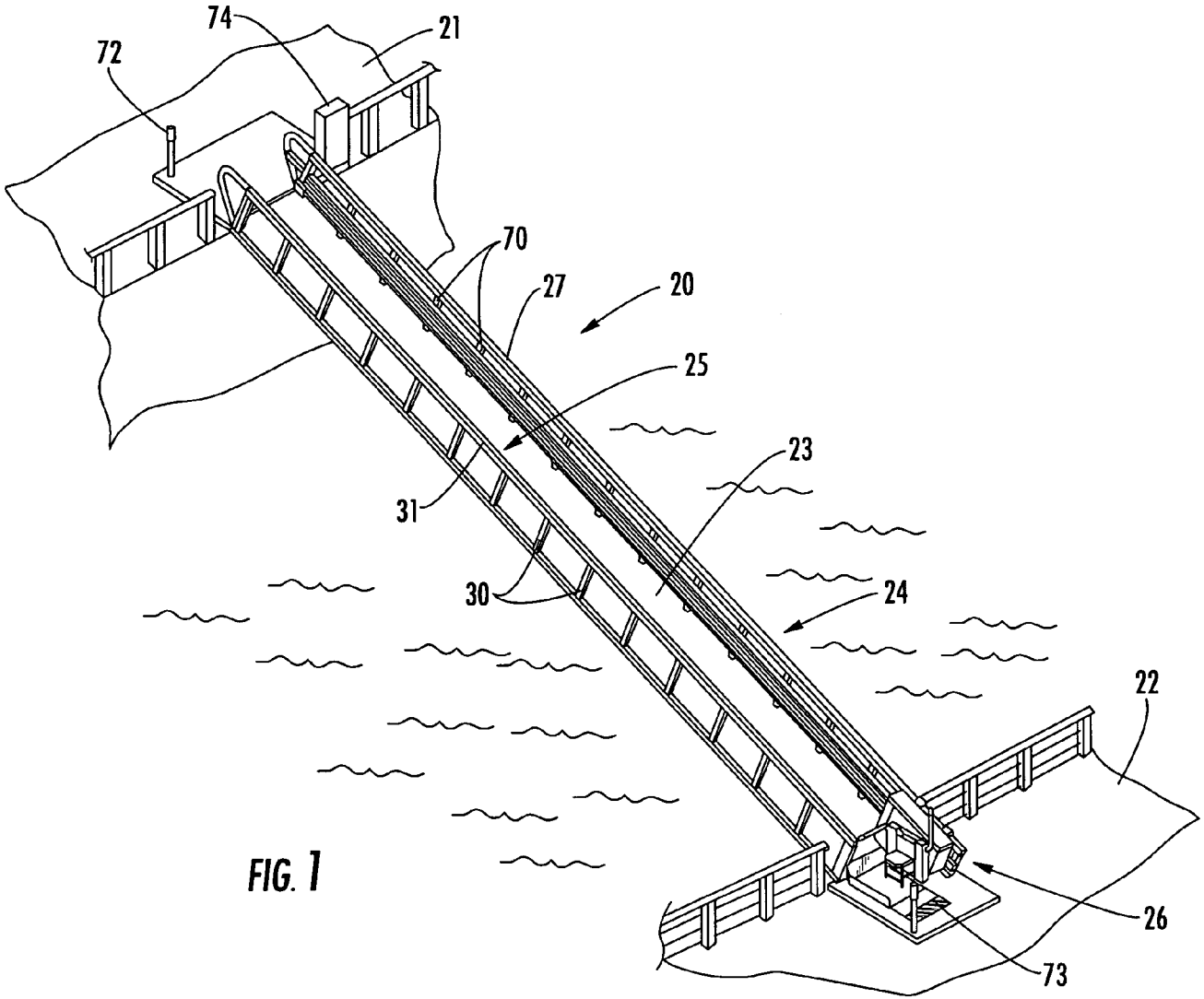
FIG. 1 is a perspective view of a marine gangway to enable handicapped users to move between floating and fixed landings in accordance with the present invention.
Figure 2:
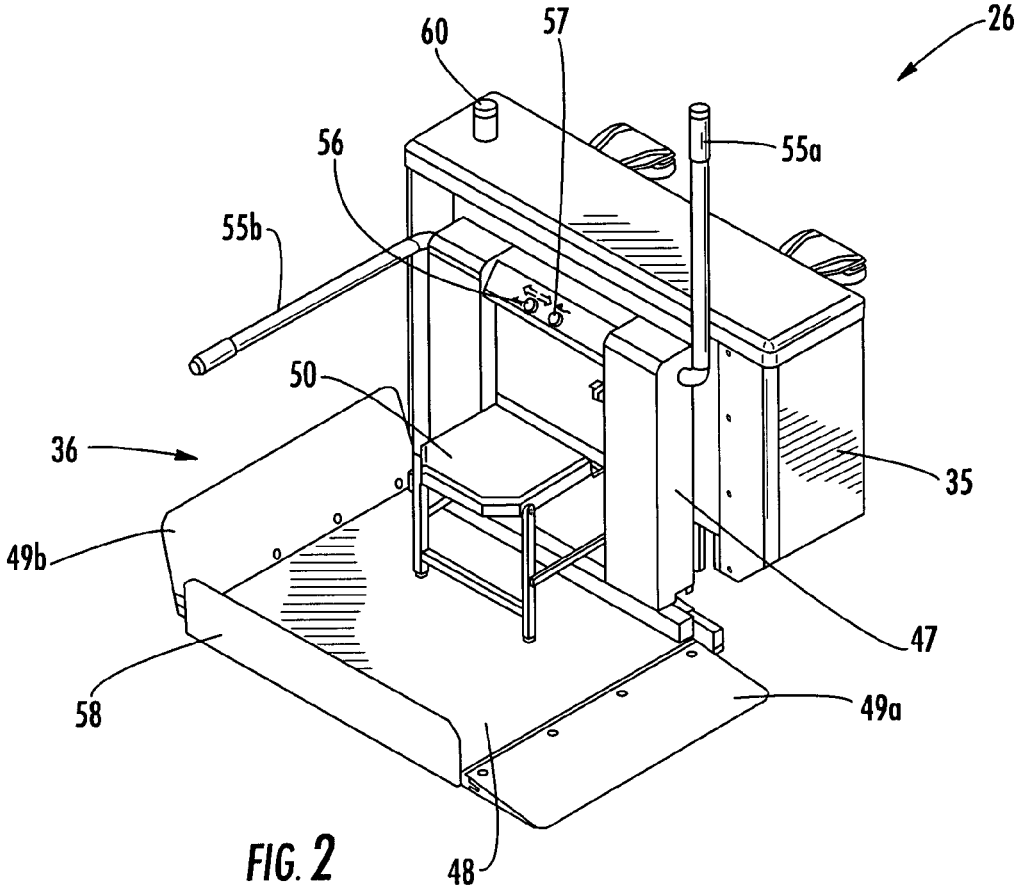
FIG. 2 is a perspective view illustrating the front of the handicapped user lift of the marine gangway of FIG. 1.
Figure 3:
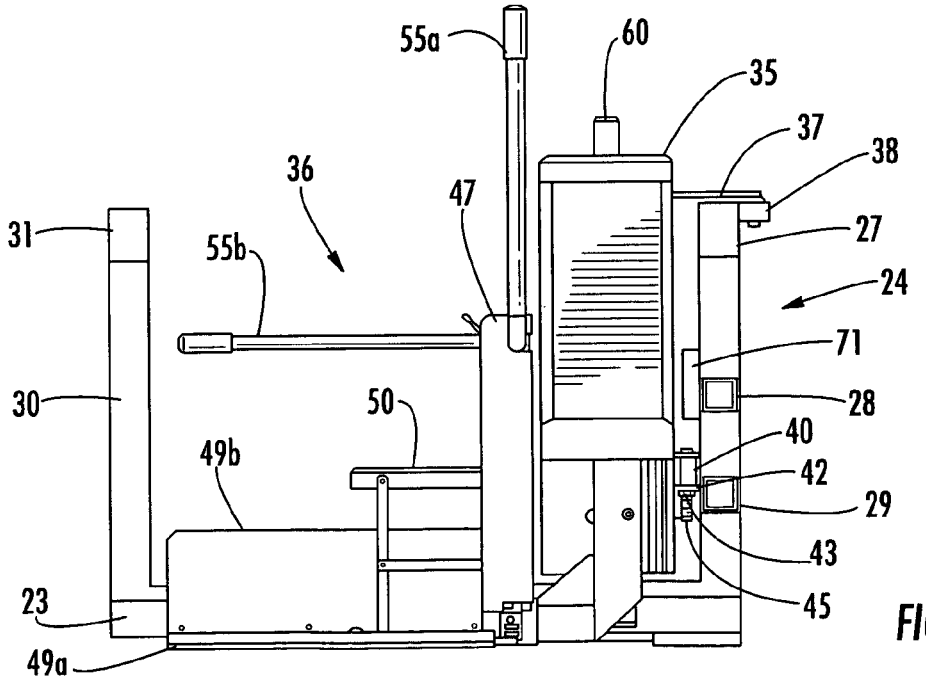
FIG. 3 is an end view of the handicapped user lift of the marine gangway of FIG. 1.
Figure 4:
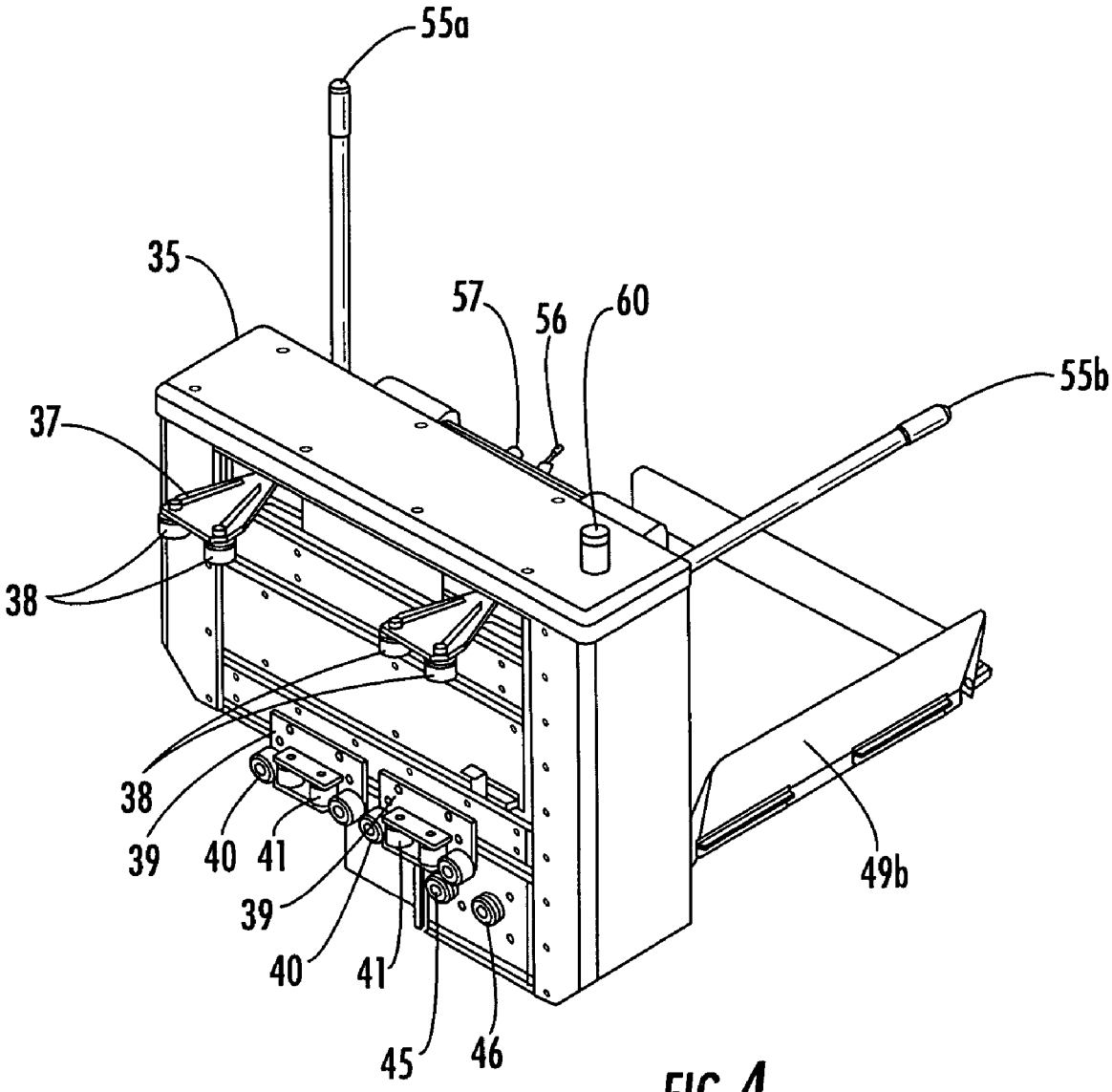
FIG. 4 is perspective view illustrating the back of the handicapped user lift of the marine gangway of FIG. 1.
Figure 5:
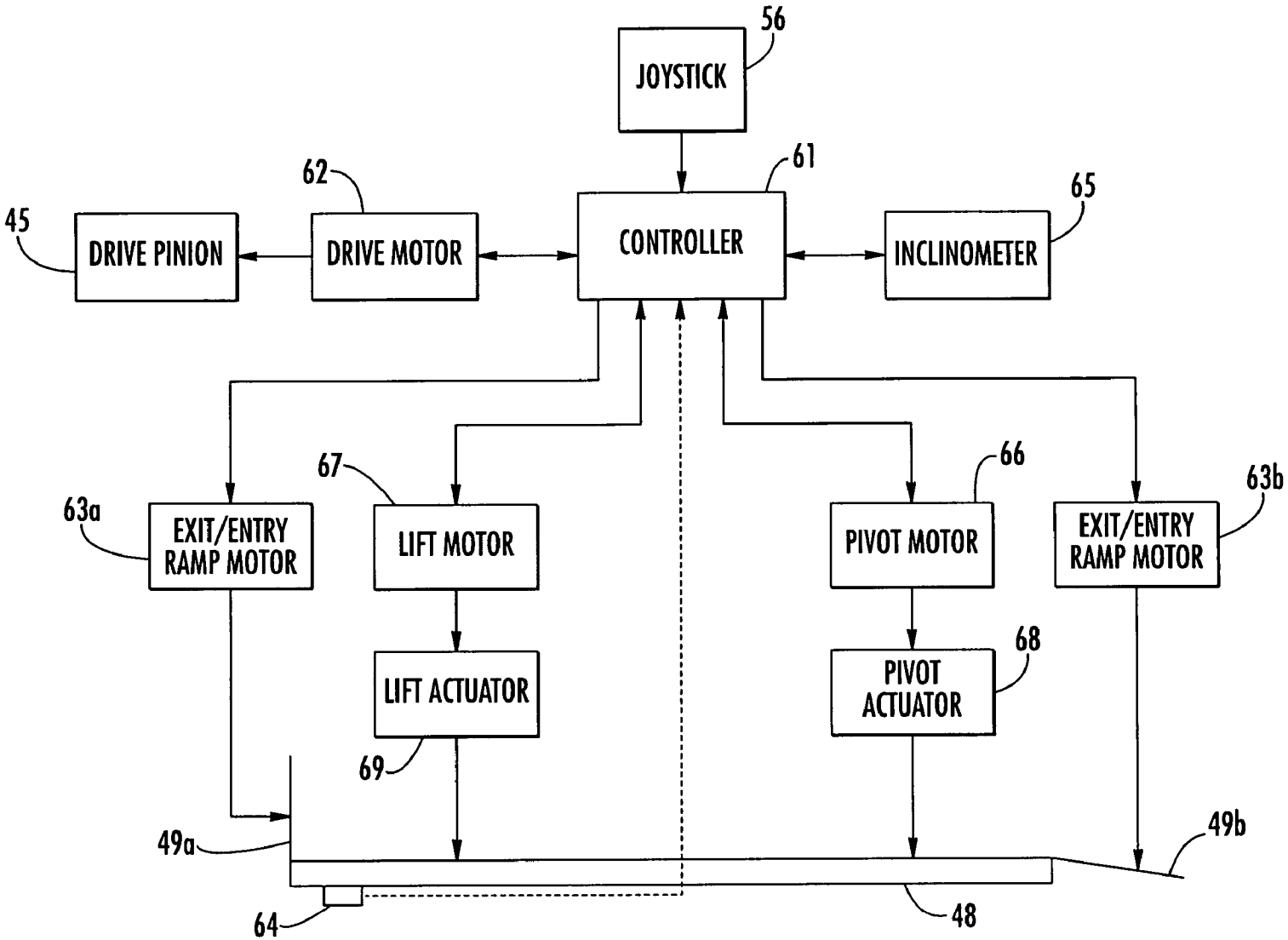
FIG. 5 is a schematic block diagram illustrating various components of the handicapped user lift of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1–5, a marine gangway 20 in accordance with the present invention is for enabling handicapped users to move between a fixed platform 21 and a floating platform 22. In the illustrated example, the fixed platform 21 is shore, and the floating platform 22 is a ship. However, it will be appreciated by those skilled in the art that the gangway 20 may be used with other fixed platforms (e.g., stationary or non-floating docks) and floating platforms (e.g., floating docks) as well, for example.

The gangway 20 illustratively includes a gangway ramp 23 extending between the fixed and floating landings 21, 22, and first and second railings 24, 25 carried by the gangway ramp. The first railing 24 is used by a handicapped user lift 26 for moving back and forth across the gangway ramp 23 between the fixed and floating platforms 21, 22, as will be discussed further below. The first railing 24 illustratively includes a plurality of posts 70 extending vertically upward from the gangway ramp 23, and top, middle, and bottom rails 27, 28, 29, respectively, carried by the posts and extending along the length of the gangway ramp 23. It should be noted that the posts 70 need not be used in all embodiments. For example, one or more rails could be mounted directly on (or recessed in) the gangway ramp 23, as will be appreciated by those skilled in the art. A cable guide or track 71 may also be carried by the first railing 24 for protecting power/signal cables connected to the handicapped user lift 26 while at the same time allowing them to move with the lift.

It should be noted that the term "handicapped" as used herein is not limited merely to those with disabilities. Instead, this term refers generally to anyone who requires assistance traversing the gangway ramp 23 for whatever reason (e.g., temporary or permanent injury, age, disability, etc.).

The second railing 25 illustratively includes a plurality of posts 30 extending vertically upward from the gangway ramp 23, and a rail 31 carried by the posts 30. The railing 25 is a safety rail, and in the illustrated embodiment it is not used by the handicapped user lift 26 for moving across the gangway. However, it will be appreciated by those skilled in the art that in some embodiments the handicapped user lift could be made to move along multiple railings, e.g., as between parallel sets of railings, if desired. The first and second railings 24, 25 may optionally have connectors at the tops thereof for receiving corresponding connectors of a canopy (not shown) to shelter handicapped users and/or components of the gangway 20 from sun, rain, etc., in some embodiments if desired.

The handicapped user lift 26 further illustratively includes a drive unit 35 coupled to the railing 24 that is movable between the floating and fixed landings 21, 22, and a handicapped user lift unit 36 carried by the drive unit. The drive unit 35 includes brackets 37 which carry guide wheels 38 that roll along the outside portion (i.e., the side facing outwardly from the gangway ramp 23) of the top rail 27 to provide lateral stability for the handicapped user lift 26.

Furthermore, the lower rail 29 has a flange 42 with a toothed rack 43 on a lower surface of the flange. The drive unit 35 also carries brackets 39 with guide wheels 40 and 41. The guide wheels 40 roll on an upper surface of the flange 42 to provide vertical support for the drive unit 35. The guide wheels 41 roll along the inside portion (i.e., the side facing inwardly toward the gangway ramp 23) to provide further lateral stability for the handicapped user lift 26.

The handicapped user lift unit 36 illustratively includes a base 47 carried by the drive unit 35 and a handicapped user platform 48 carried by the base. Moreover, entry/exit or loading ramps 49*a*, 49*b* are attached via hinges (e.g., pneumatic hinges) to each end of the platform 48 so that they may be raised and lowered to facilitate loading and unloading of wheelchairs, scooters, etc., as will be described further below. A seat 50 is connected to the base 47 which may be folded out for handicapped users who are not in a wheelchair but still require assistance traversing the gangway ramp 23. A guard 58 may optionally be mounted on the side of the platform 48 opposite the base 47 to keep wheelchair tires from going off of the side of the platform, for example.

The base 47 further carries pivotable safety bars 55*a*, 55*b* which are raised when a respective exit/entry ramp 49*a*, 49*b* is lowered, and vice versa. That is, the safety bars 55*a*, 55*b* are raised to permit loading, and lowered for safety during transit. The base 47 also carries one or more user control devices for allowing a user to control the movement of the handicapped user lift 26. More particularly, a joystick 56 allows a user to move the handicapped user lift 26 to the desired landing 21 or 22. An emergency stop button 57 causes the handicapped user lift 26 to cease movement if necessary. A light 60 (or other suitable indicator) may be included for indicating when then handicapped user lift 26 is in transit, when a user needs assistance, etc. if desired.

The toothed rack 43 is engaged by a drive pinion 45 and a brake pinion 46. The drive pinion 45 is for propelling the drive unit 35 back and forth across the gangway 23, and the brake pinion 46 is used for stopping the drive unit when it reaches the landings 21, 22, or during transit if necessary. Of course, it will be appreciated by those skilled in the art that in some embodiments a single drive pinion may be used both for moving and stopping the drive unit 35 and the separate brake pinion 46 may be omitted. In the illustrated embodiment, the toothed rack 43 is on the bottom of the flange 42, but it may be located elsewhere in other embodiments.

The handicapped user lift unit 36 pivots with respect to the drive unit 35 to be level at at least one of the floating and fixed landings. As such, the handicapped user lift unit 36 may remain level in a loading/unloading position at the floating or fixed landing despite changes in inclination of the gangway ramp 23, which prevents damage to the lift unit as a result thereof. That is, while the handicapped user lift unit 36 is at one of the fixed or floating landings 21, 22 waiting for a user, as the floating landing goes up or down (e.g., with the tide) it changes the angle of the gangway ramp 23 and railing 24 makes relative to the landings. As such, if the handicapped user lift unit 36 did not pivot, a rotational torque would be imparted thereon which could severely damage the unit and/or the landing, as well as make it difficult to load and unload.

It should also be noted that the handicapped user lift unit 36 may optionally pivot to be level while moving between the fixed and floating landings 21, 22 as well, to thereby keep the user level while traveling along the gangway ramp 23. Generally speaking, leveling the handicapped user lift unit 36 at the fixed and floating landings 21, 22 will be sufficient, since tidal changes occur gradually over several hours and, thus, the inclination change of the gangway ramp 23 over the relatively short duration of travel will be negligible. However, in some applications where the floating landing may be subject to waves, etc., leveling adjustment during transit may be desirable.

The gangway 20 may further include one or more controllers 61 for controlling the drive unit 35 and the handicapped user lift unit 36. The controller 61 is connected to a drive motor 62 carried by the drive unit 35 which operates the drive pinion 45 to move the handicapped user lift 26 between the fixed and floating landings 21, 22 based upon actuation of the joystick 56 by the user, or upon being called from the send/call stations 72, 73 at the fixed, floating landings, respectively. By way of example, the controller 61 may be an Allan-Bradley/Rockwell Automation Logix series programmable controller, a Micrologics model 1200 controller, etc., although other suitable controllers may also be used, as will be appreciated by those skilled in the art.

Moreover, the drive unit 35 also includes one or more ramp motors 63*a*, 63*b* connected to the controller 61 for raising/lowering the entrance/exit ramps 49*a*, 49*b* and/or the safety bars 55*a*, 55*b*. In particular, a ground detection switch or sensor 64 is mounted on the bottom of the handicapped user platform 48 and is connected to the controller 61 (the sensor 39, as well as the remainder of the handicapped user lift 26, may be compliant with the A17.1 standard for elevators, for example). The controller 61 senses that the handicapped user platform 48 is on the ground based upon the ground detection switch 64. When this occurs, the controller 61 causes the appropriate ramp motor 63*a* or 63*b* to lower the respective entrance/exit ramp 49*a*, 49*b* and raise the corresponding safety bar 55*a*, 55*b* based upon whether the handicapped user lift 26 is at the fixed or floating landing 21, 22, and vice-versa when the platform 48 leaves the ground, as will be appreciated by those skilled in the art.

Additionally, an inclinometer 65 detects a pitch of the handicapped user lift unit 36. A pivot motor 66 drives a pivot actuator 68 to adjust the pitch of the handicapped user platform 48 responsive to the controller 61 based upon the inclination readings provided by the inclinometer 65. For example, this may be done in one-half degree increments, although other increments may be used as well. It should be noted that the inclinometer 65 need not be used in all embodiments to provide leveling functionality. For example, multiple ground detection switches 64 could be positioned at different locations on the bottom of the handicapped user platform 48 (e.g., one at each end of the platform adjacent the entry/exit ramps 49*a*, 49*b*), and the controller 61 could adjust the inclination of the platform based upon activation of the various sensors, as will be appreciated by those skilled in the art.

A lift motor 67 is connected to the controller 61 and a lift actuator 69 for raising and lowering the handicapped user platform 48 between the loading/unloading and traveling positions. The drive, pivot, and lift motors 62, 66, 67 may have a relatively high static rating, for example, 3000 lb. By way of example, the motors 66, 67 may be Baldor, brushless DC servo motors, for example, although other suitable motors (including AC motors) may also be used, as will be appreciated by those skilled in the art.

Figure 6:
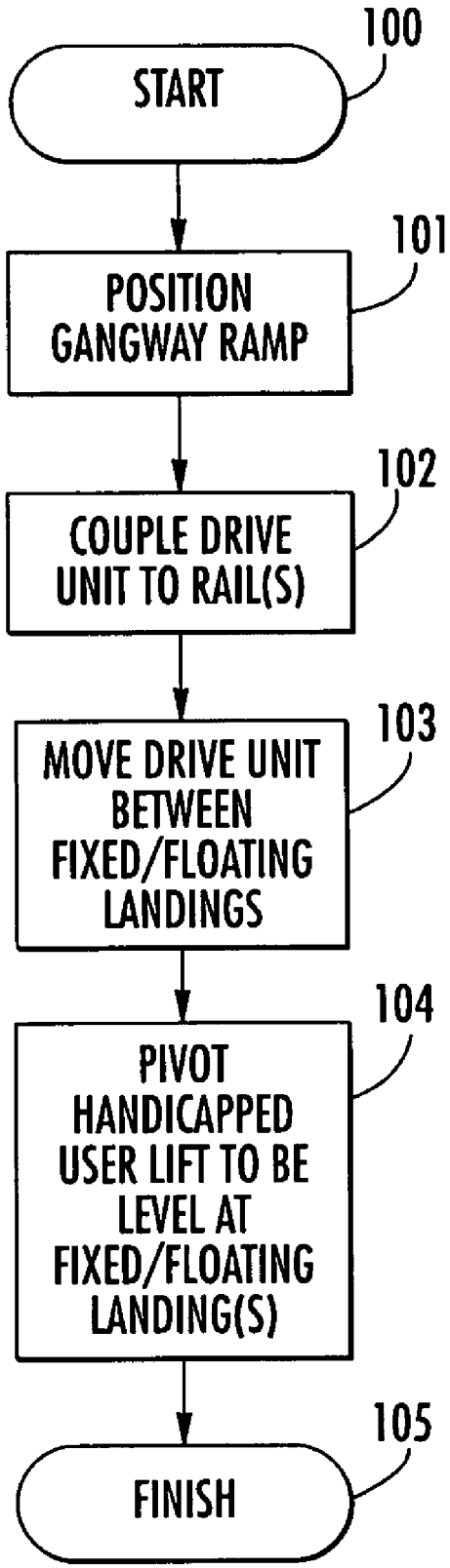
FIG. 6 is a flow diagram illustrating a method for operating a handicapped user lift in accordance with the present invention.

A method aspect of the invention for using the handicapped user lift 26 is now described with reference to FIG. 6. The method begins (Block 100) with positioning a gangway ramp 23 having at least one rail 27, 29 carried thereby to extend between fixed and floating landings 21, 22, at Block 101, and coupling the drive unit 35 to the at least one rail, at Block 102. The method may further include moving the drive unit 35 between the fixed and floating landings 21, 22, at Block 103, and pivoting the handicapped user lift unit with respect to the drive unit 36 to be level at at least one of the floating and fixed landings, at Block 104, as discussed above, to conclude the illustrated method (Block 105).

Additional features and operational details of the gangway 20 will now be described. Each of the drive, pivot, and lift systems are preferably servo controlled, meaning that each drive provides feed back in terms of location and speed to the controller 61. This provides for safe, constant control of each system during operation. The handicapped user lift 26 can be operated by the joystick 56 and send and call stations 72, 73 located at the fixed and floating landings 21, 22, respectively. The handicapped user lift 26 is designed to remain turned "on" with power at all times. In addition, the unit 26 is run from batteries (not shown) and therefore may run with short-term service power outages, as will be discussed further below.

The controller 61 is located in the drive unit 35 on the handicapped user lift 26. The controller 61 calculates distances and rates of travel for the handicapped user lift 26 and outputs this data to the motors 62, 66, 67 for travel, rotation, and lift, respectively, as will be appreciated by those skilled in the art.

The handicapped user lift 26 is automated in terms of travel, rotate and lift. Therefore, it preferably has a point of reference when it is turned on. This point of reference is called home. "Homing" is when an automated system moves to a point that the controller knows is the point of reference, or home. Home for the handicapped user lift 26 is at the fixed landing 21 in the present example, although it may be located at the floating landing 22 in other embodiments.

The handicapped user lift 26 lifts the handicapped user platform 48 up or down relative to the ground. The platform 48 is the part of the system that the rider rides on. It is preferably always level with ground during operations. A proximity sensor may also be included on the handicapped user lift 26, such as a sensor that can detect metal objects with a relatively high degree of accuracy (e.g., within approximately an inch). The handicapped user lift 26 preferably uses one or more proximity sensors to detect the home location for the system.

The handicapped user platform 48 automatically rotates to stay level with the fixed and floating landings 21, 22. This feature is preferably performed during a self preservation loop, which is described further below, when the handicapped user lift 26 is called or sent, and when the handicapped user lift unit is homed.

Another important consideration for operation of the handicapped user lift 26 is that the lowering distances of the handicapped user platform 48 at both ends of the gangway 20 change as the tide changes. The smaller the tide (relative to a level gangway ramp 23), the more distance is required to lower the platform 48 to its respective landing. The handicapped user lift 26 preferably always lifts the handicapped user platform 48 to its full up or traveling position. This automated feature is performed when the handicapped user lift 26 is sent or called, is homing, is performing its self-preservation loop, and at both the fixed and floating landings 21, 22 during the travel loop.

The exit/entry ramps 49*a*, 49*b* and safety bars 55*a*, 55*b* automatically raise and lower at the end of the travel control loop. The travel loop is what the handicapped user lift 26 does while it is sent/called or joystick operated. This loop includes the following steps. The appropriate entry/exit ramp 49*a*, 49*b* raises and the corresponding safety bar 55*a*, 55*b* lowers. The platform 48 then lifts (if in a down position from either the fixed or the floating landings 21, 22), stops when fully lifted, and the handicapped user lift 26 begins to travel toward the fixed or the floating landing. Once the desired landing 21, 22 is reached, the handicapped user lift 26 stops and lowers the platform 48 to the landing, and the opposite exit/entry ramp 49*a*, 49*b* lowers and the corresponding safety bar 55*a*, 55*b* raises. The direction of travel can be reversed at anytime. Each of these operations may take a few moments to begin.

The send/call stations 71, 72 are located at both ends of the gangway ramp 23. The send/call station buttons preferably have a "dead man" feature, in that they have to be continuously pushed for the handicapped user lift 26 to operate. The send/call stations 71, 72 may also have an emergency stop button that will stop the handicapped user lift 26 in case of an emergency. The joystick 56 preferably also has to be continuously pushed (forward or backward) for the handicapped user lift 26 to operate. The joystick enclosure is permanently mounted to the drive unit 35.

The emergency stop buttons are preferably push to latch and turn to release buttons. An emergency stop cuts all power to the drive unit 35. Once an emergency stop button is pushed, an emergency bell located in a power supply cabinet 74 for the gangway 20 will sound until it is released. The handicapped user lift 26 may have to be re-homed after an emergency stop button is activated. Therefore, the emergency stop buttons are preferably not used as a primary power switch for the handicapped user lift 26.

As noted above, the platform 48 has one or more safety pressure-sensing ground switches 64 located on the bottom thereof. The switches 64 are calibrated to stop lowering of the system if there is an object underneath the platform 48 as it lowers. The platform 48 will not lower until the object is removed. Preferably, the switches 64 should be sensitive enough to prevent injury to persons who may stick appendages under the platform 48 as it lowers, for example.

Once the handicapped user lift 26 is turned on, it is preferably homed. This is done so that the controller 61 will know exactly where the handicapped user lift 26 is at all times. To home the handicapped user lift 26, the call button at the fixed landing 21 send/call station 72 is pressed and held down. While doing so, the operator should watch the handicapped user lift 26. One of two things will happen. Namely, the exit/entry ramps 49*a*, 49*b* will raise (if down) and the safety bars 55*a*, 55*b* will lower (if up), or the light 60 on the handicapped user lift 26 will flash and beep for six seconds.

The lift motor 67 will lift the platform 48 all the way up to its traveling position (if it not already all the way up), and the pivot motor 66 will rotate the platform all the way to the left as you face the handicapped user lift 26 (if it is not already all the way to the left). The handicapped user lift 26 will move to the fixed landing 21 at half speed and stop abruptly (if it is not all the way to the fixed landing as determined by the proximity switches). The handicapped user lift 26 will then level (if it is not already level). The handicapped user lift 26 will then lower the platform 48, and the operator releases the call button.

At this point, the operator pushes the send button and watches the handicapped user lift 26 fully raise the platform 48 begin to move along the gangway ramp 23. The operator then lets the handicapped user lift 26 move a few feet, re-pushes the call button, and waits until the handicapped user lift 26 to come back to the fixed landing 21 and begin to lower. At this point the system is home.

Homing is only required once after the handicapped user lift 26 first receives power. After that, the handicapped user lift 26 knows where it is at all times. If the handicapped user lift 26 is turned off (using the system disconnect) or is disconnected from the batteries, it will have to be re-homed.

Wheelchair users load onto the platform 48 by rolling their wheel chair up the appropriate entry/exit ramp 49*a*, 49*b* and onto the platform. The wheelchair should be moved as far forward as possible. Users not in wheel chairs walk onto the platform 48, raise the seat latch, lower the chair 50 and sit down facing the direction of travel.

To travel using the joystick 56, the user pushes and holds the joystick towards the desired direction of travel. The appropriate entry/exit ramp 49*a*, 49*b* behind the user raises and the corresponding safety bar 55*a*, 55*b* lowers automatically. The platform 48 will then lift and halt momentarily. The user continues to push the joystick 56 during these operations. The handicapped user lift 26 will then begin moving along the gangway ramp 23. To stop the handicapped user lift 26, the user simply releases the joystick 56. The handicapped user lift 26 will take a moment to come to a complete stop to advantageously avoid jerking the user. The handicapped user lift 26 will then halt at the end of travel and then lower to the loading/unloading position at the fixed or floating landing 21, 22. The opposite entry/exit ramp 49*a*, 49*b* will then lower and the corresponding safety bar 55*a*, 55*b* will raise so that the user may exit the handicapped user lift 26.

As noted above, the handicapped user lift 26 is programmed with a self-preservation loop. This prevents the handicapped user lift 26 from being damaged due to tide changes, and also prevents the lift from interfering with the floating landing 22 to which it is connected. When left down at the floating landing 22, the handicapped user lift 26 is set to update its position and, more particularly, to level itself, every fifteen minutes. Of course, the handicapped user lift 26 may be set to perform position/leveling updates at other intervals as well. When this occurs the brakes and/or motors 62, 66, 67 may turn off and on to perform the appropriate position/leveling adjustments.

The handicapped user lift 26 is designed to be operated during short term power outages. It does so using a pair of batteries located in the power supply cabinet 74, although more or less batteries may be used in different embodiments. Preferably, an inverter is also used to continuously charge the batteries while normal power is available. Extensive use of the handicapped user lift 26 during power outages is not recommended, and, more particularly, such use should be held to thirty minutes or less. The handicapped user lift 26 is preferably left on at all times, much like an elevator.

Any time the emergency stop button is pushed at either of the send/call stations 72, 73 or on the handicapped user lift 26, an emergency audible indicator will sound. The audible indicator continues to sound until the emergency stop button is released. The emergency bell may be located in the power supply cabinet 74, for example, although it may also be located on the handicapped user lift 26 or at the other end of the gangway 20, if desired.

The controller 61 monitors the feed back devices on the handicapped user lift 26 and the pivot actuator(s) 68. If these feed back devices become inoperable then the handicapped user lift 26 preferably shuts down, and the green lights on the send/call stations 72, 73 will light, e.g., in three second intervals. Additionally, the above-noted warning horn will sound, e.g., also in three second intervals to indicate that service needs to be contacted.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A marine gangway to enable handicapped users to move between floating and fixed landings comprising:

a gangway ramp extending between the floating and fixed landings;

at least one rail carried by said gangway ramp;

a drive unit coupled to said at least one rail and movable between the floating and fixed landings; and a handicapped user lift unit carried by said drive unit and pivoting with respect thereto to be level at at least one of the floating and fixed landings.

2. The marine gangway of claim 1 wherein said handicapped user lift unit also pivots to be level while moving between the floating and fixed landings.

3. The marine gangway of claim 1 further comprising at least one controller for controlling said drive unit and said handicapped user lift unit.

4. The marine gangway of claim 1 further comprising an inclinometer for determining an inclination of said handicapped user lift unit, and wherein said handicapped user lift unit pivots based upon the determined inclination of said handicapped user lift.

5. The marine gangway of claim 1 further comprising a user control device carried by said handicapped user lift unit, and wherein said drive unit moves based upon said user control device.

6. The marine gangway of claim 1 wherein said handicapped user lift unit comprises a seat.

7. The marine gangway of claim 1 further comprising a toothed rack carried by said at least one rail, and wherein said drive unit comprises a pinion for engaging said toothed rack.

8. The marine gangway of claim 1 further comprising a plurality of posts connected to said gangway ramp and extending vertically upward therefrom, and wherein said at least one rail is carried by said plurality of posts.

9. The marine gangway of claim 1 wherein said handicapped user lift unit comprises a handicapped user platform.

10. The marine gangway of claim 9 further comprising a lift actuator carried by said drive unit; wherein said handicapped user platform is carried by said lift actuator; and wherein said lift actuator raises and lowers said handicapped user platform between a traveling position and a loading position at at least one of the floating and fixed landings.

11. The marine gangway of claim 10 wherein said handicapped user platform has upper and lower surfaces; and further comprising a pressure-sensitive switch positioned on the lower surface of said handicapped user platform for causing said lift actuator to disengage.

12. The marine gangway of claim 9 wherein said handicapped user lift unit further comprises at least one loading ramp carried by said handicapped user platform.

13. A marine gangway to enable handicapped users to move between floating and fixed landings comprising:

a gangway ramp extending between the floating and fixed landings;

at least one rail carried by said gangway ramp;

a drive unit coupled to said at least one rail and movable between the floating and fixed landings;

a handicapped user lift unit carried by said drive unit and pivoting with respect thereto;

an inclinometer for determining an inclination of said handicapped user lift unit; and at least one controller for controlling said drive unit, and for causing said handicapped user lift unit to pivot based upon the determined inclination to be level at at least one of the floating and fixed landings.

14. The marine gangway of claim 13 further comprising a user control device carried by said handicapped user lift unit, and wherein said at least one controller controls said drive unit moves based upon said user control device.

15. The marine gangway of claim 13 wherein said handicapped user lift unit comprises a handicapped user platform.

16. The marine gangway of claim 15 further comprising a lift actuator carried by said drive unit; wherein said handicapped user platform is carried by said lift actuator; and wherein said at least one controller causes said lift actuator to raise and lower said handicapped user platform between a traveling position and a loading position at at least one of the floating and fixed landings.

17. The marine gangway of claim 15 wherein said handicapped user lift unit further comprises at least one loading ramp carried by said handicapped user platform.

18. A handicapped user lift for use with a marine gangway ramp extending between floating and fixed landings and at least one rail carried by the gangway ramp, said handicapped user lift comprising:

a drive unit coupled to the at least one rail and movable between the floating and fixed landings; and a handicapped user lift unit carried by said drive unit and pivoting with respect thereto to be level at at least one of the floating and fixed landings.

19. The handicapped user lift of claim 18 wherein said handicapped user lift unit also pivots to be level while moving between the floating and fixed landings.

20. The handicapped user lift of claim 18 further comprising at least one controller for controlling said drive unit and said handicapped user lift unit.

21. The handicapped user lift of claim 18 further comprising an inclinometer for determining an inclination of said handicapped user lift unit, and wherein said handicapped user lift unit pivots based upon the determined inclination of said handicapped user lift.

22. The handicapped user lift of claim 18 wherein said handicapped user lift unit comprises a handicapped user platform.

23. The handicapped user lift of claim 22 further comprising a lift actuator carried by said drive unit; wherein said handicapped user platform is carried by said lift actuator; and wherein said lift actuator raises and lowers said handicapped user platform between a traveling position and a loading position at at least one of the floating and fixed landings.

24. A method for using a handicapped user lift comprising a drive unit and a handicapped user lift unit carried thereby, the method comprising:

positioning a gangway ramp having at least one rail carried thereby between floating and fixed landings;

coupling the drive unit to the at least one rail;

moving the drive unit between the floating and fixed landings; and pivoting the handicapped user lift unit with respect to the drive unit to be level at at least one of the floating and fixed landings.

25. The method of claim 24 further comprising pivoting the handicapped user lift unit with respect to the drive unit to be level while moving between the floating and fixed landings.

26. The method of claim 24 further comprising determining an inclination of the handicapped user lift unit using an inclinometer; and wherein pivoting comprises pivoting the handicapped user lift unit based upon the determined inclination.

27. The method of claim 24 wherein the handicapped user lift unit comprises a handicapped user platform; and further comprising raising and lowering the handicapped user platform between a traveling position and a loading position at at least one of the floating and fixed landings.

* * * * *